US009915017B2

(12) United States Patent
Padgett et al.

(10) Patent No.: US 9,915,017 B2
(45) Date of Patent: Mar. 13, 2018

(54) TUFTED PATTERNED TEXTILES WITH OPTIMIZED YARN CONSUMPTION

(71) Applicant: Tuftco Corporation, Chattanooga, TN (US)

(72) Inventors: Robert A Padgett, Chattanooga, TN (US); Jeffrey D. Smith, Chattanooga, TN (US)

(73) Assignee: Tuftco Corporation, Chattanooga, TN (US)

( * ) Notice: Subject to any disclaimer, the term of this patent is extended or adjusted under 35 U.S.C. 154(b) by 0 days.

(21) Appl. No.: 15/406,713

(22) Filed: Jan. 14, 2017

(65) Prior Publication Data

US 2017/0204546 A1 Jul. 20, 2017

Related U.S. Application Data

(60) Provisional application No. 62/278,853, filed on Jan. 14, 2016.

(51) Int. Cl.

| | |
|---|---|
| ***D05C 5/02*** | (2006.01) |
| ***D05B 19/10*** | (2006.01) |
| ***D05B 19/12*** | (2006.01) |
| ***D05C 5/04*** | (2006.01) |
| ***D05C 15/26*** | (2006.01) |

(52) U.S. Cl.

CPC ..... *D05B 19/10* (2013.01); *D05B 19/12* (2013.01); *D05C 5/04* (2013.01); *D05C 15/26* (2013.01)

(58) Field of Classification Search

CPC ..... D05B 19/00; D05B 19/02; D05B 19/08; D05B 19/10; D05B 19/12; D05C 5/00; D05C 5/02; D05C 5/04; D05C 15/26

USPC ..... 700/136–138

See application file for complete search history.

(56) References Cited

U.S. PATENT DOCUMENTS

| | | | | |
|---|---|---|---|---|
| 8,359,989 | B2 | 1/2013 | Hall | |
| 9,399,832 | B2 * | 7/2016 | Hall | D05C 15/34 |
| 2009/0205547 | A1 * | 8/2009 | Hall | D05C 15/26 112/80.41 |
| 2009/0260554 | A1 * | 10/2009 | Hall | D05C 15/34 112/80.4 |

OTHER PUBLICATIONS

Tuftco Corp., Tuftco Design System Suite for Windows 2000, 2006, Self published, U.S.

Nedgraphics, Vision Tuft 2004 User Guide, Self published, U.S.

Nedgraphics, Texcelle 2007 User Guide, Self published, U.S.

Yamacuchi Sangyo Co. Ltd., Design Tuft Tufting Machine, May 13, 2002, Self published, Japan.

Cobble Tufting Machine Company, Inc. ColorTec Operating and Maintenance Manual Servotec Software Version 3.10. xx Apr. 2005.

Windows PCCI Operator's Manual, Verision 1.0, dated Mar. 13, 1998.

Crawshaw, Carpet Manufacture, Chap. 7 Patterning Systems for Tufted Carpets, WRONZ Developments 2002.

Wool Research Organisation of New Zealand (Inc.), Carpet Technical Information, Carpet Manufacture, Broadloom tufting, Part 1, 2002, Self published, NZ.

* cited by examiner

*Primary Examiner* — Nathan Durham

(74) *Attorney, Agent, or Firm* — Miller & Martin PLLC

(57) ABSTRACT

A method is provided for optimizing the yarn consumption in patterned textiles by applying cell automata algorithms to bitmapped-type pattern designs including operator selected rules to influence the general appearance of the pattern design.

16 Claims, 10 Drawing Sheets

TUFTED PATTERNED TEXTILES WITH OPTIMIZED YARN CONSUMPTION

The present application claims the benefit of U.S. Provisional Application Ser. No. 62/278,853 filed on Jan. 14, 2016.

FIELD OF THE INVENTION

The invention relates to a manufacture of patterned textiles, and more particularly the design and manufacture of tufted patterned textiles having optimized yarn consumption.

BACKGROUND OF THE INVENTION

In the manufacture of patterned textiles, and particularly in the manufacture of tufted textile products, designs are created for fabrics in a pixel-mapped format where each pixel in a graphic representation corresponds to a separate tuft or bight of yarn that is displayed on the surface of the tufted carpet. Pixel-mapped designs became prevalent as a result of the evolution of tufting machines to possess the capability of placing a particular color of yarn at virtually any location in a given pattern. In the field of broadloom tufting machines, this capability was present in the mid to late 1990s with computer controlled needle bar shifters, servo motor driven backing feeds, and servo motor driven yarn feed pattern controls. However, even decades earlier simple patterns could be tufted in a similar fashion as typified by Hammel, U.S. Pat. No. 3,103,187 using photoelectric cells to read instructions for actuation of electromagnetic clutch operated yarn feeds.

Other types of tufting machines such as hollow needle machines manufactured by Tapistron, or the Colortron machines manufactured by Tuftco Corp. have the ability to place any color of yarn in any location of the backing fabric. Independent control needle ("ICN") machines typified by Cobble's ColorTec machines, also could place any color yarn at any position on backing fabric from about 1994.

Tufted textile fabrics may be manufactured from a single color of yarn threaded in all the needles of a tufting machine. However, in commercial and hospitality markets, it is much more common that patterns will have between about three to six colors of yarn, and in some cases, even more. When using multiple colors of yarn in a pattern, it often happens that some colors are utilized more heavily than others and particular needles on the tufting machine may utilize more of one color yarn than is utilized by a different needle tufting even the same color. These variations in yarn consumption can lead to inefficiencies.

The production of completed tufted textiles generally involves several distinct steps. First is the selection or creation of a pattern. Second is the tufting of a fabric by placing the yarns in a backing fabric according to the pattern. Finally, there are finishing steps to remove irregularities, to lock the tufted yarns in place with the application of a secondary backing, and to trim any uneven margins as the fabric is cut to size.

The creation of tufted fabric involves feeding yarns to needles on a tufting machine, and reciprocating the needles to insert the yarns through the backing fabric. By controlling operations such as the shifting of needles, the feeding of the backing fabric, the amounts of yarn fed to specific needles, the types of knives and gauge parts operating to seize or cut yarns carried through the backing fabric, and in the case of ICN tufting machines, the selection of needles to penetrate the backing fabric, almost any design can be created on a properly configured and threaded tufting machine.

It can be seen that the inputs necessary to create the tufted fabric include labor, yarn, backing fabric and the typically multi-million dollar investment in a tufting machine and yarn creel. Such tufting machines, while built on a chassis not unlike those from the last century, now include sophisticated electronics and software in addition to the many precision reciprocating and electronically driven parts that operate to move the yarns and backing as required.

With the evolution of tufting machines, the possibilities for patterns have evolved from solids, textures, geometrics, repeated graphics, and copies of woven textiles, to encompass nearly photographic representations of a wide range of images. Furthermore, patterns may now be over 1000 positions in both width and length, leading to designs with over a million individual pixel-mapped positions. In modern designs, carpet patterns that have organic or natural aspects, perhaps with the appearance of fallen leaves or similar designs inspired by nature or entropy, have emerged as desirable for many large spaces.

Since a tufting machine is a sizable fixed investment that should justify its cost over several years of production, the opportunities to minimize the overall cost of creating tufted fabrics must focus on the labor and materials consumed in that production. Labor is involved in creating designs and in configuring tufting machines for each individual pattern to be run, especially the threading of yarns to the individual needles and positioning of yarn cones in a yarn creel or the winding of beams to feed the yarns to the needles.

In addition, there is wasted yarn when patterns do not utilize similar amounts of colors of yarn fed to needles across the width of the tufting machine. This leads to two inefficiencies. First, if for example a red yarn is fed to a needle on the right side of the tufting machine and will consume a three pound yarn cone over the course of production of a pattern while a red yarn fed to a needle in the center of that machine will consume a four pound yarn cone, some compromise must be made. Either four pound yarn cones are placed in all positions on the creel for red yarns or three pound and four pound yarn cones must be prepared and positioned in appropriate places on the creel to feed yarns to the appropriate needle. In the former case, an extra pound of yarn will be left on the cones that were associated with needles only using three pounds of red yarn and that yarn will need to be salvaged. In the latter case, additional labor, with increased possibilities of improper configuration of the yarn creel, is injected into the configuration process.

SUMMARY OF THE INVENTION

Since it may take several weeks to manually calculate and balance yarn consumption across large patterns, it is desirable to utilize software to automate the calculation of information about the yarn consumed on a per-needle per-color basis for use by designers. It is also desirable to provide tools to facilitate the balancing of yarn consumption over the course of a pattern or over a series of patterns using the same color palette. To provide these features, design software can be operated to calculate the yarn consumption by color and needle. In addition, software can apply algorithmic modifications to a pattern to balance yarn consumption while altering the appearance of the pattern in selected ways, perhaps to minimize the appearance of alteration, for instance, leading to the more efficient creation of tufted fabrics.

BRIEF DESCRIPTION OF THE DRAWINGS

The particular features and advantages of the invention as well as other objects will become apparent from the following description taken in connection with the accompanying drawings in which.

DETAILED DESCRIPTION OF THE INVENTION

Figure 1A:
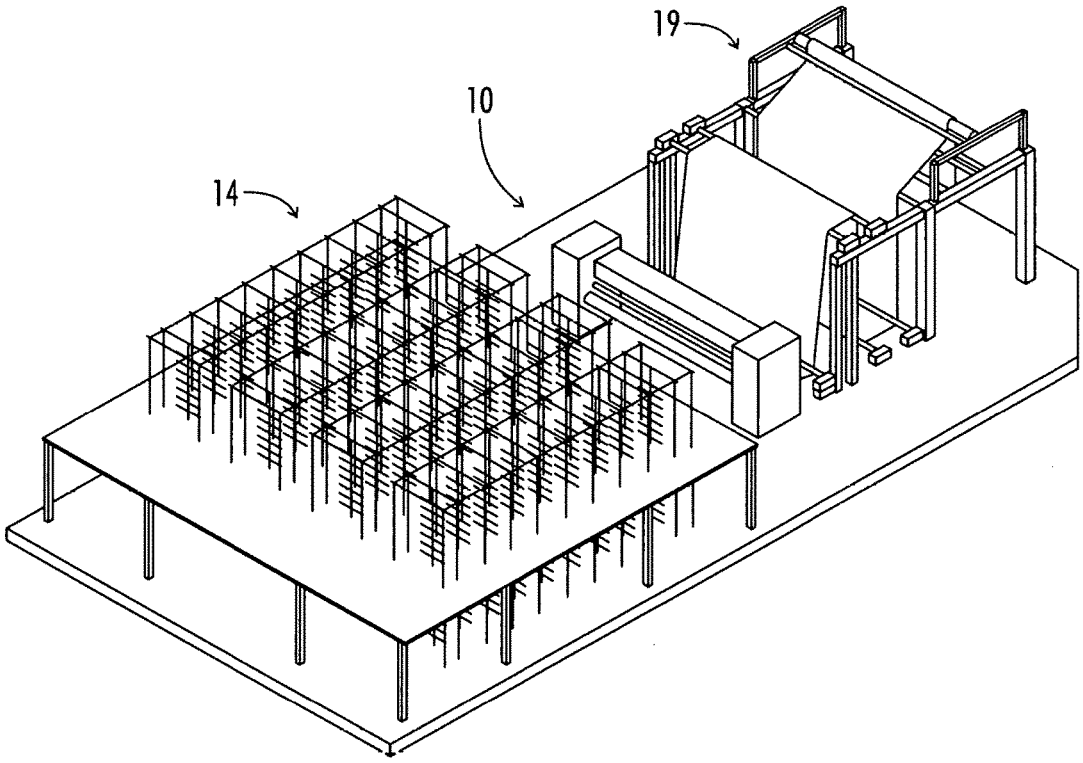
FIG. 1A is a perspective view of a tufting machine and creel.

Turning then to FIG. 1A, a general depiction of the tufting machine 10 with take up rolls 19 for the tufted fabric and two story creel 14 to hold cones of yarn is illustrated. It should be understood that the invention can be practiced on a wide variety of tufting machines, not simply the broadloom machine 10 depicted in FIG. 1A. For instance, ColorTec ICN machines and Colortron hollow needle tufting machines also have the capability to place yarns in individual pixel locations according to a pattern and thus are suitably adapted to utilize with the invention. In addition, the yarn creel set up is exemplary and yarns could be supplied to the tufting machine from a single story creel or from beams that are wound for use in supplying yarns. In the typical case there will be hundreds of separate yarns fed from the creel, most frequently between about 600 and 1800 yarns and most commonly between about 1100 and 1700 yarns, although some machine and pattern combinations, such as relatively narrow hollow needle machines tufting patterns with a limited number of colors, could operate with a smaller number. A sample machine would typically have a substantially smaller tufting width and a smaller number of yarns would be fed into the pattern. The yarns will often be fed independently of other yarns using single end pattern control yarn feed devices. However, yarn optimization is also practical on tufting machines using double end or quadruple end yarn feeds, or even servo scroll yarn feed devices that carry larger pluralities of yarns that are typically distributed across the width of the tufting machine by a tube bank, or other yarn feed arrangements with an array of independent yarn feed drives. There will preferably be more than 72 independent yarn feed drives in the array and most commonly more than 300 independent yarn feed drives.

Figure 1B:
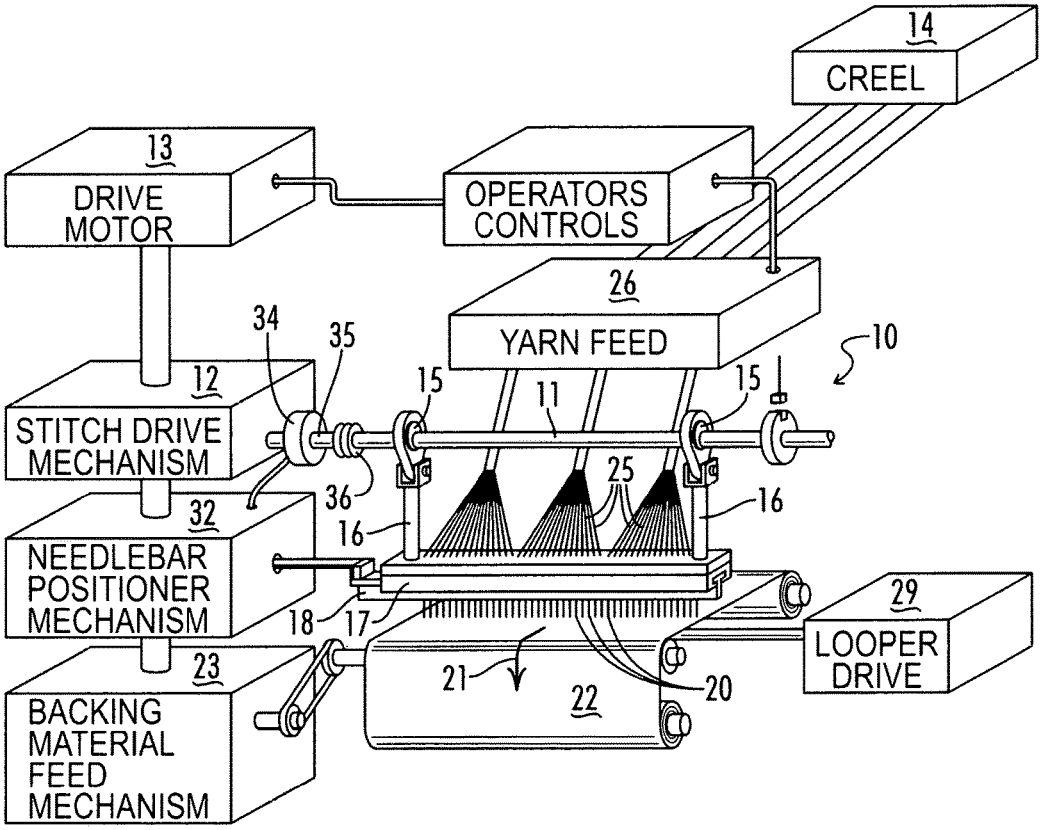
FIG. 1B (PRIOR ART)
FIG. 1B is a simplified diagrammatic illustration of a tufting machine showing operative components.

The tufting machine 10 disclosed in FIG. 1B includes a rotary needle shaft or main drive shaft 11 driven by stitch drive mechanism 12 from a drive motor or other conventional means. Rotary eccentric mechanism 15 mounted upon rotary needle shaft 11 is adapted to reciprocally move the vertical push rod 16 for vertically and reciprocally moving the needle bar slide holder 17 and needle bar 18. The needle bar 18 supports a plurality of uniformly spaced tufting needles 20 in a longitudinal row, or staggered longitudinal rows, extending transversally of the feeding direction of the backing fabric or material 22. The backing fabric 22 is moved longitudinally in direction 21 through the tufting machine 10 by the backing fabric feed mechanism 23 and across a backing fabric support with needle plate and needle plate fingers.

Yarns 25 are fed from the creel 14 to the pattern control yarn feed 26 to the respective needles 20. As each needle 20 carries a yarn 25 through the backing fabric 22, a hook is reciprocally driven by the looper drive 29 to cross each corresponding needle 20 and hold the corresponding yarn end 25 to form loops. Cut pile tufts are formed by cutting the loops with knives. A cut/loop or Level Cut Loop (LCL) apparatus may also be employed, and may have its own controller, just as do the yarn feed, needle bar or backing shifter, and backing feed apparatus.

The needle bar shifting apparatus 32 is designed to laterally or transversely shift the needle bar 18 relative to the needle bar holder 17 a predetermined transverse distance equal to the needle gauge or multiple of the needle gauge, and in either transverse direction from its normal central position, relative to the backing fabric 22, and for each stroke of the needles 20. Alternatively, a jute or backing shifter may move the backing fabric laterally with respect to a stationary needle bar.

In order to generate input encoder signals for the needle bar shifting apparatus 32 corresponding to each stroke of the needles 20, an encoder 34 may be mounted upon a stub shaft 35, or in another suitable location, and communicate positional information from which a tufting machine controller can determine the position of the needles in the tufting cycle. Alternatively, drive motors may use commutators to indicate the motor positions from which the positions of the associated driven components may be extrapolated by the controller. Operator controls 24 also interface with the tufting machine controllers to provide necessary pattern information to the storage associated with the various tufting machine controllers before machine operation.

On a broadloom tufting machine, these components can be operated in a fashion to provide pixel-addressed yarn placement as described in various prior patents such as U.S. Pat. Nos. 6,439,141; 7,426,895; and 8,359,989 and continuations thereof. Pixel controlled yarn placement in connection with ICN machines is described in U.S. Pat. Nos. 5,382,723 and 5,143,003; while pixel controlled placement of yarns utilizing hollow needle tufting machines is described in U.S. Pat. Nos. 4,549,496 and 5,738,030. All these patents are incorporated herein by reference. Software to facilitate such pixel mapped designs has been available from NedGraphics since at least about 2004 in the form of its Texcelle and Tuft programs, from Tuftco Corp. in the form of its Tuftco Design System, and from Yamaguchi in the form of its design system for similar lengths of time.

Figure 2:
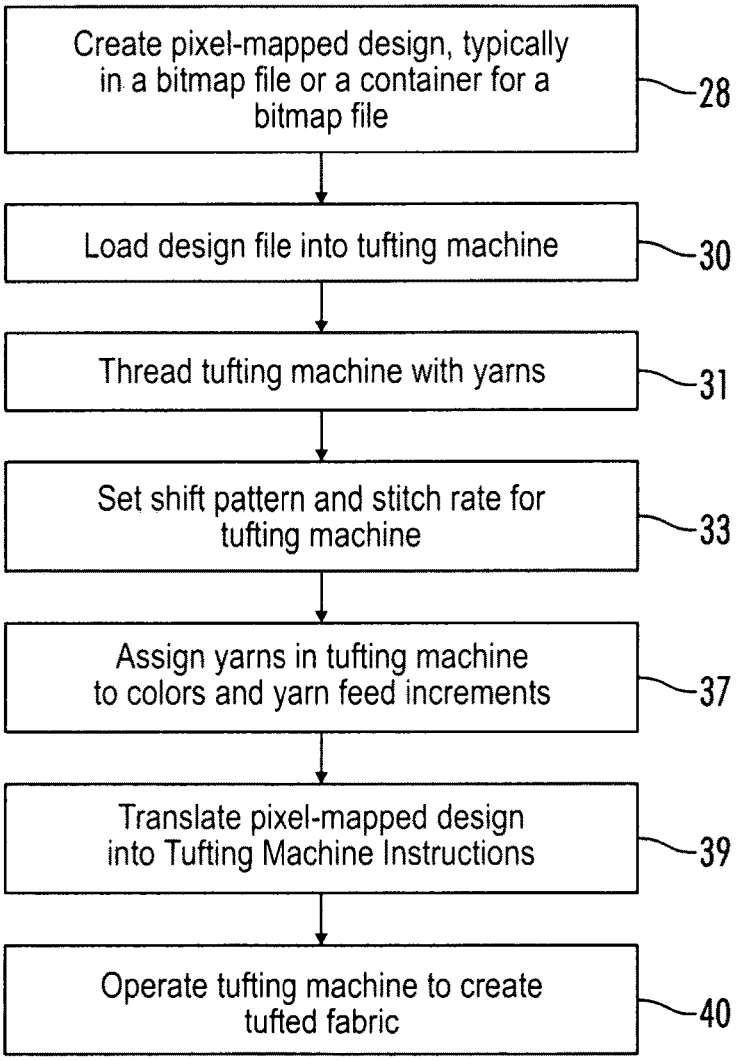
FIG. 2 is a flow diagram illustrating exemplary steps presently used in designing and manufacturing tufted fabric.

Turning then to the existing process of designing and manufacturing tufted fabric as reflected in FIG. 2, the first step 28 is the creation of a graphic design to be tufted. The design can be created by an artist or adapted from a photograph or preexisting image. In either case, the image should be created or processed to limit the color palette to a manageable number of yarn colors, preferably between two and twelve, and most commonly three to six colors. Preferably, this design process is executed on a design workstation running Texcelle or Tuftco Design software although sometimes automated design features can be included in the Operator Interface of a tufting machine.

Figure 4:
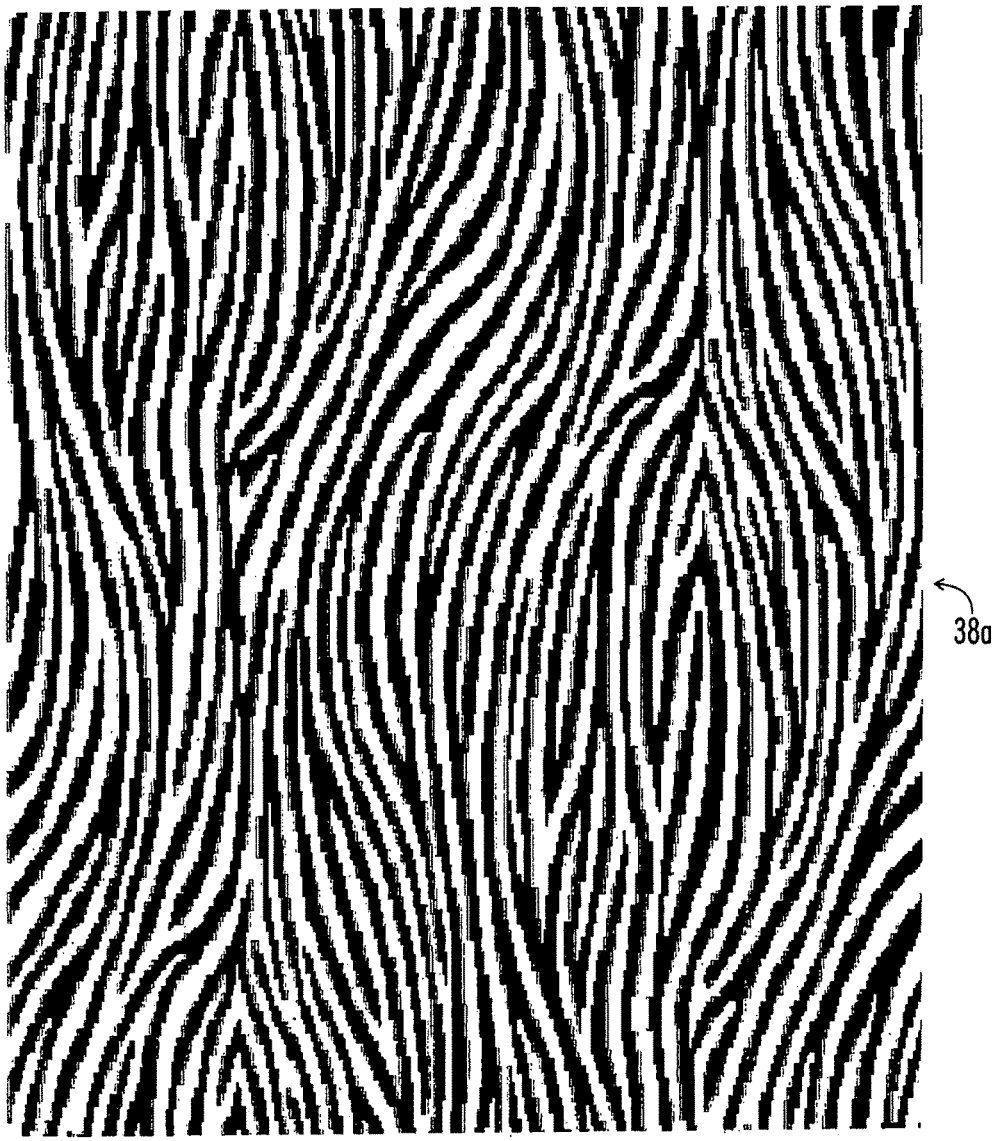
FIG. 4 is a pixel representation of a fabric design that is suitable for tufting.

For illustrative purposes, a two color pattern 38*a* has been prepared in FIG. 4 in the general configuration of black and white "zebra" stripes. The pattern is enlarged sufficiently that the right angles indicating individual black or white pixels or yarn tufts can be observed.

Figure 5:
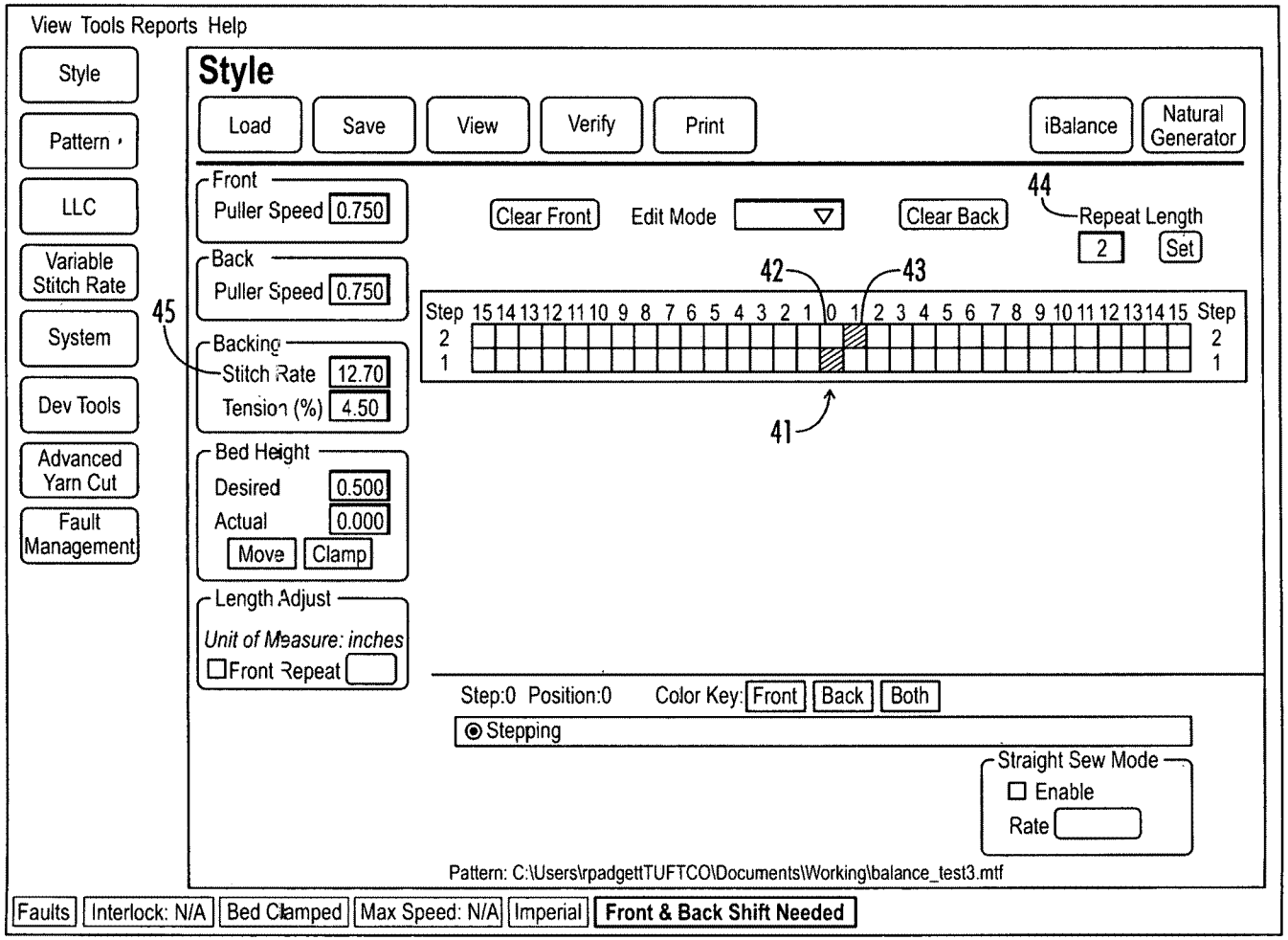
FIG. 5 is an exemplary control screen display for the input of design and tufting parameters, and especially a needle bar shift profile.

The next step 30 is to load the image into a tufting machine having a controller running an operator interface software such as the iTuft system sold by Tuftco Corp. and to process the pattern graphics to create machine instructions. The tufting machine should be threaded with appropriate yarns 31. When using the iTuft system, there are two principal steps prior to creating machine instructions. One step 33 (in FIG. 2), carried out as reflected in FIG. 5, is to assign a shift pattern or step pattern 41 to the needle bar 37 (shown in FIG. 2) and a stitch rate to the pattern. In the case of a two color pattern, it is quite practical to use a very simple stepping pattern of over and back so that the needle bar merely moves from dead center 42 to a position offset by one gauge unit 43 and then repeats. In this case, the repeat length 44 is only two steps. In the event that a four color pattern were being tufted, a typical stepping pattern could involve two steps to the right, four steps to the left, and two steps to the right. Variations of the shift profile for other numbers of colors utilized on a broadloom tufting machine are well known and easily computed. It can also be seen that the stitch rate 45 may be specified which can affect the density of yarn bights and the weight of the resulting tufted fabrics.

Figure 6:
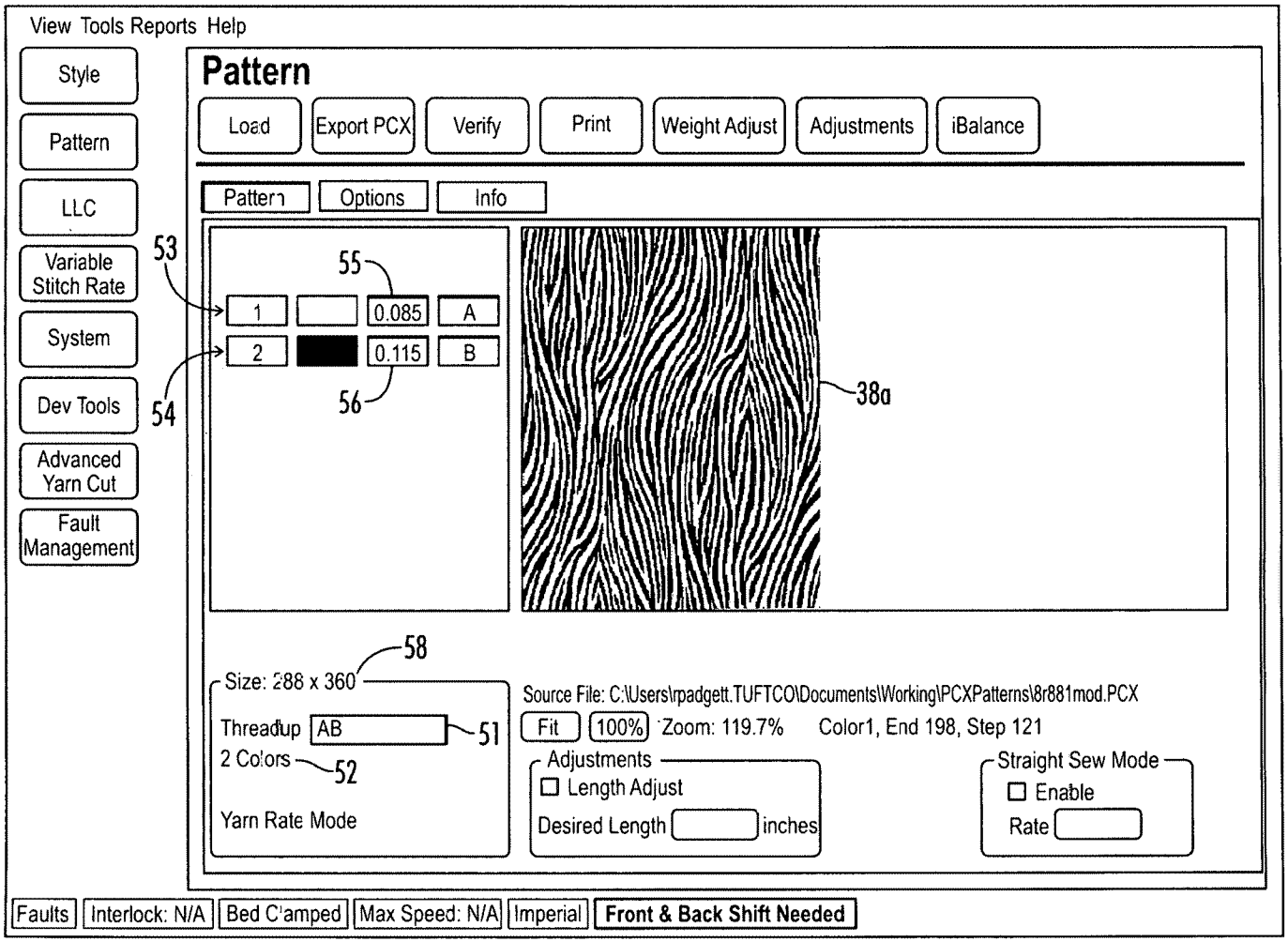
FIG. 6 is an exemplary control screen display for inputting a pattern and tufting parameters and specifically yarn assignments and yarn feed increments.

In addition to entering the stepping pattern in FIG. 5, in the iTuft system the yarns and yarn feed increments are assigned to the colors in the graphic pattern 37 (in FIG. 2) using the operator controls in FIG. 6. In this example, the threadup 51 is only A and B yarns, or two colors 52, and the white yarns "A" are assigned 53 to needle 1 and odd needles, and black yarns "B" are assigned 54 to needle 2 and even needles, and tufting heights 55,56 are set. In the prior art, at this point the pixel-mapped design can be translated into tufting machine instructions 39. Tufting machines instructions in the form of a yarn feed pattern array for the yarn feed drives, a shift pattern array for each shifter moving the needle bars or backing fabric, a backing feed instruction (or array in the event of varied stitch rates), and a cut/loop array if operating an LCL type apparatus are transferred from the computer running the iTuft operator interface system to storage accessible by the controllers for the yarn feed, shifter, backing feed, and LCL apparatus and the tufting machine 10 operated to produce a tufted fabric of the design 40.

Figure 3:
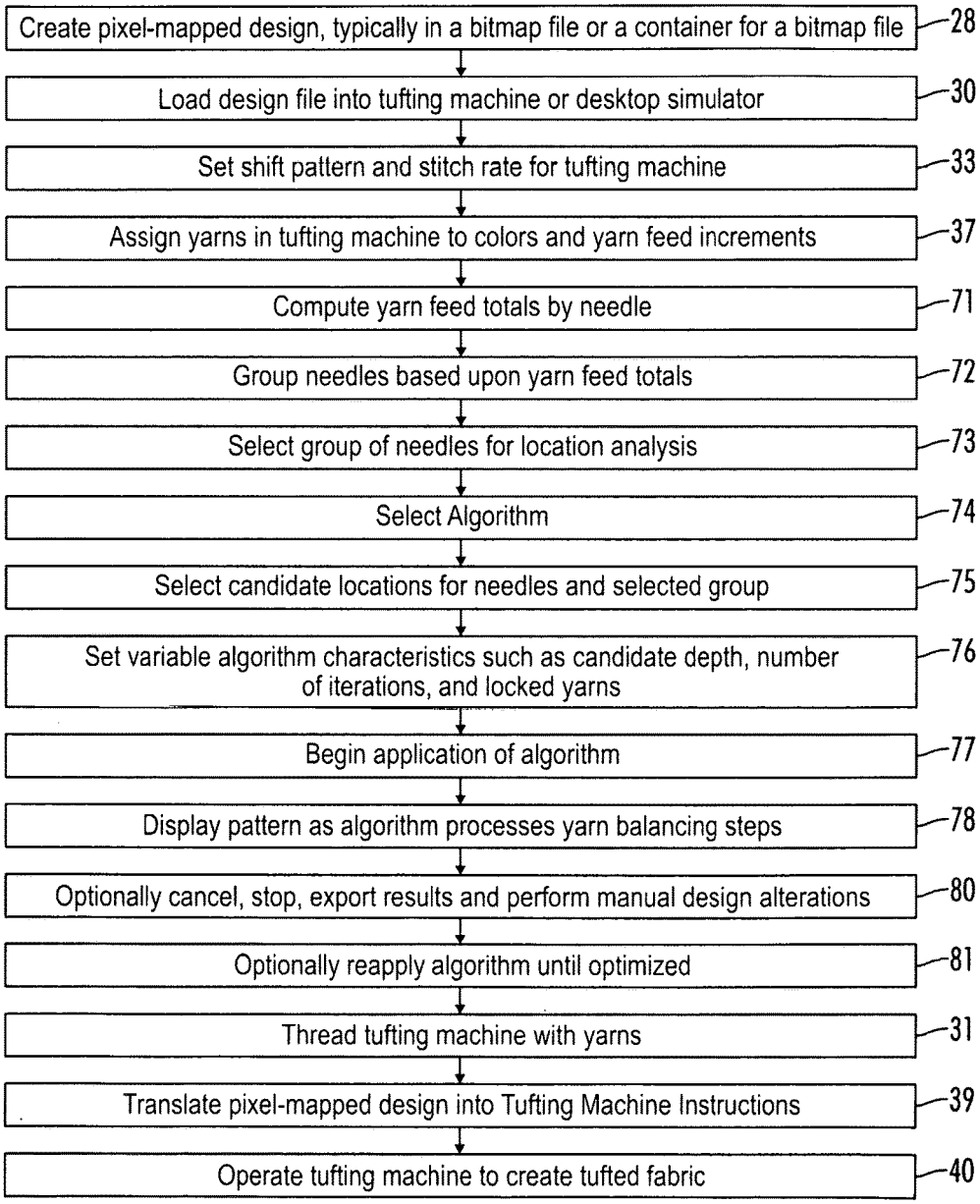
FIG. 3 is a flow diagram of exemplary steps in practicing a yarn balancing method in connection with designing patterns to manufacturing tufted fabrics.

Using the yarn optimization techniques of the invention requires some modifications to the prior art process. The pixel-mapped design is created as before 28 but then the design file is loaded into a tufting machine, or more typically a desk top simulator, 30. Then the shift pattern and stitch rate are set 33 and yarn feed increments assigned to colors in the design 37. After the pattern has been associated with yarns, yarn feed increments, and a stepping pattern, it is then possible to compute the yarn consumption for each needle 71 as shown in FIG. 3. This calculation involves combining the lengths of yarn that are utilized in shifting yarns from one position to another in addition to the lengths of yarn that are actually fed and tufted into the backing fabric and at least NedGraphics and Tuftco have provided this functionality in their design software. In the case where a single yarn drive feeds multiple yarns or in a hollow needle type machine where several yarns are selectively fed through a single needle, the calculation may be performed for the yarn fed by a single yarn feed drive.

Figure 7:
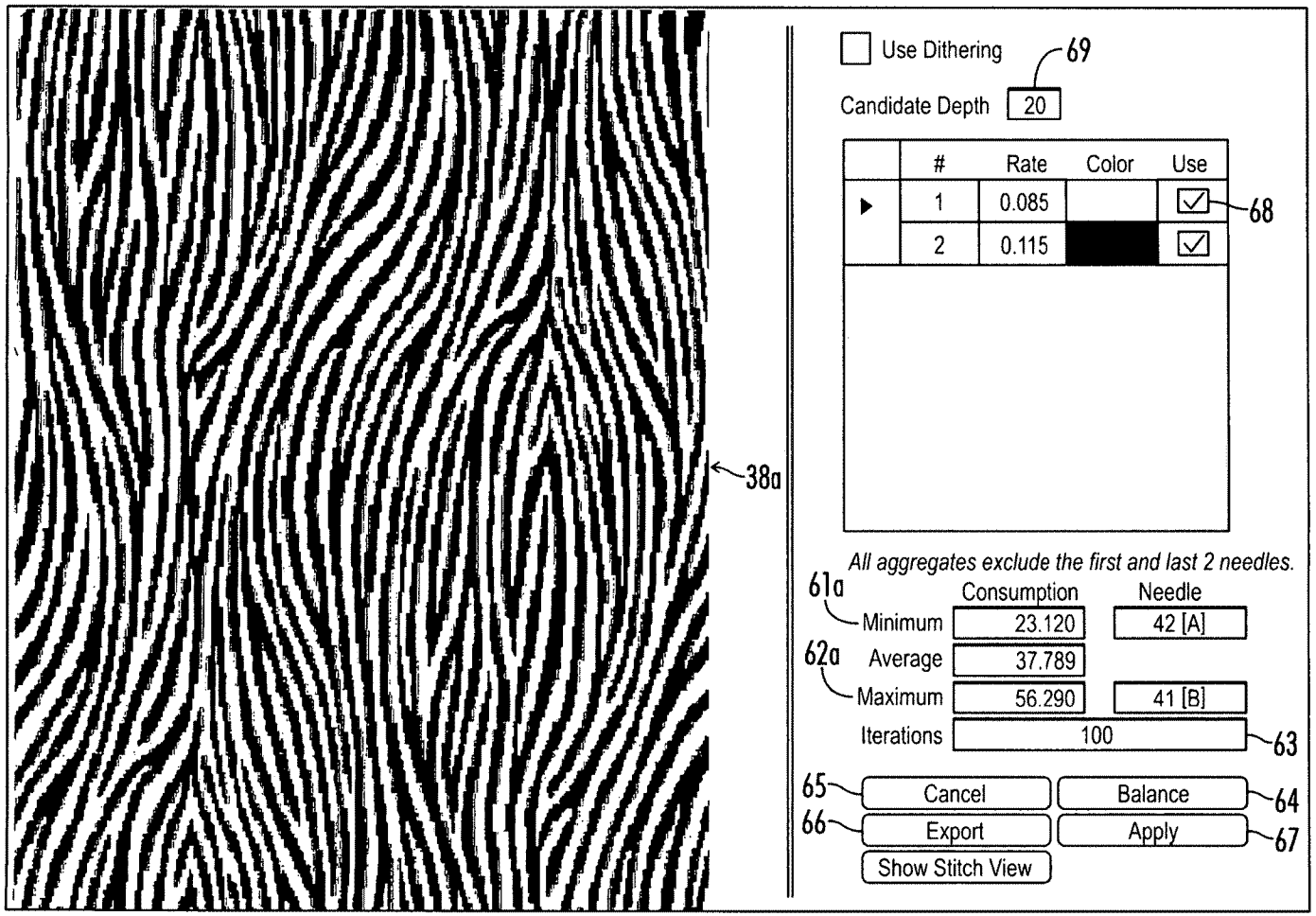
FIG. 7 is an exemplary control screen illustrating controls that can be utilized to apply a balancing algorithm to a design.

After calculating yarn consumption for each needle on the tufting machine, information regarding yarn consumption is provided to the operator or designer. For instance, in FIG. 7, it can be seen that the minimum yarn consumption 61 per pattern repeat on needle 42[A] which is tufting white yarn is over 14 inches less than average while the maximum yarn consumption 62 on needle 41[B] which is tufting black yarn is about 18.5 inches above average. In the event that the operator wishes to balance yarn consumption, the "balance" control 64 provides for the application of an algorithm to adjust the pattern.

As depicted in the flow diagram of FIG. 3, each needle is analyzed sequentially. For instance, while the needles in the first and last threadup repeats on a broadloom machine are generally excluded (since those needles are only over the sewing area about half the time and would greatly distort average yarn consumption figures), at some location relatively near the edge—often the fourth needle or so, the needle in position n is analyzed to determine whether it is tufting a greater or lower than average amount of yarn over the course of the pattern. The needle is then classified 72 into a group of high feed needles or low feed needles, and optionally also a group of reasonably optimally fed needles, then the algorithm passes to the needle n+1.

Then either the high feed group or low feed group of needles is selected for adjustment 73 and a particular algorithm may be selected 74 in the event the system is programmed with a plurality of algorithms. So if low feed needles are selected, each needle is tufting a lower than the average amount, and an analysis is conducted to determine the possible locations that additional tufts of the yarn carried by low feed needle n may be advantageously placed. In a pattern with a long repeat, such as hundreds or thousands of stitches, it is not practical to calculate every possible variation, and it is most efficient to select a subset of candidate stitch locations 75 for a particular needle and analyze that subset for locations that are likely favorable for the placement of an additional bight of yarn carried by the examined needle. So, for instance in a pattern having a stitch length of 1000, it is entirely feasible to perform calculations for only about 15 to 45 candidate stitch locations (depth) for each needle in the group.

Figure 9:
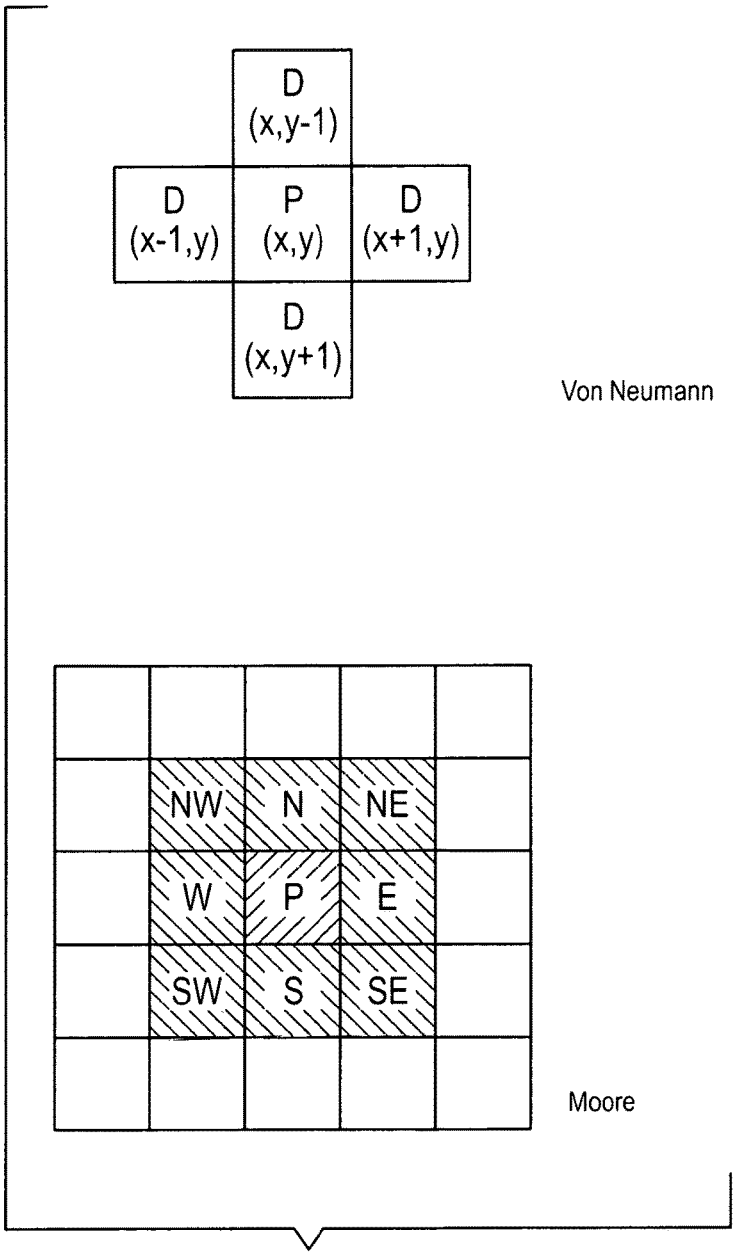
FIG. 9 is a graphic representation of Von Neuman and Moore Neighborhood points.

Among the algorithms that can be advantageously used to determine likely suitability for placement of an additional bight of a particular color are cell automata algorithms such as Von Neumann and Moore neighborhood algorithms as represented in their simplest forms in FIG. 9. In unmodified form, these algorithms determine in which candidate locations there are already the highest concentration of yarns of the same color as that being tufted by needle n and from that group of highly ranked locations conducts a lottery to pick a single location and applies rules to determine where to place an additional tuft of yarn on needle n. Rules for instance would require that the new tuft of yarn on needle n not be replacing a yarn that is on a needle that is underfeeding or optimally feeding. Additional rules may be implemented as desired to affect the appearance of the resulting balanced pattern. After determining stitches for substitution with yarn from needles in the group, the graphic display is updated as are the yarn feed calculations and groupings for the affected needles.

Figure 8:
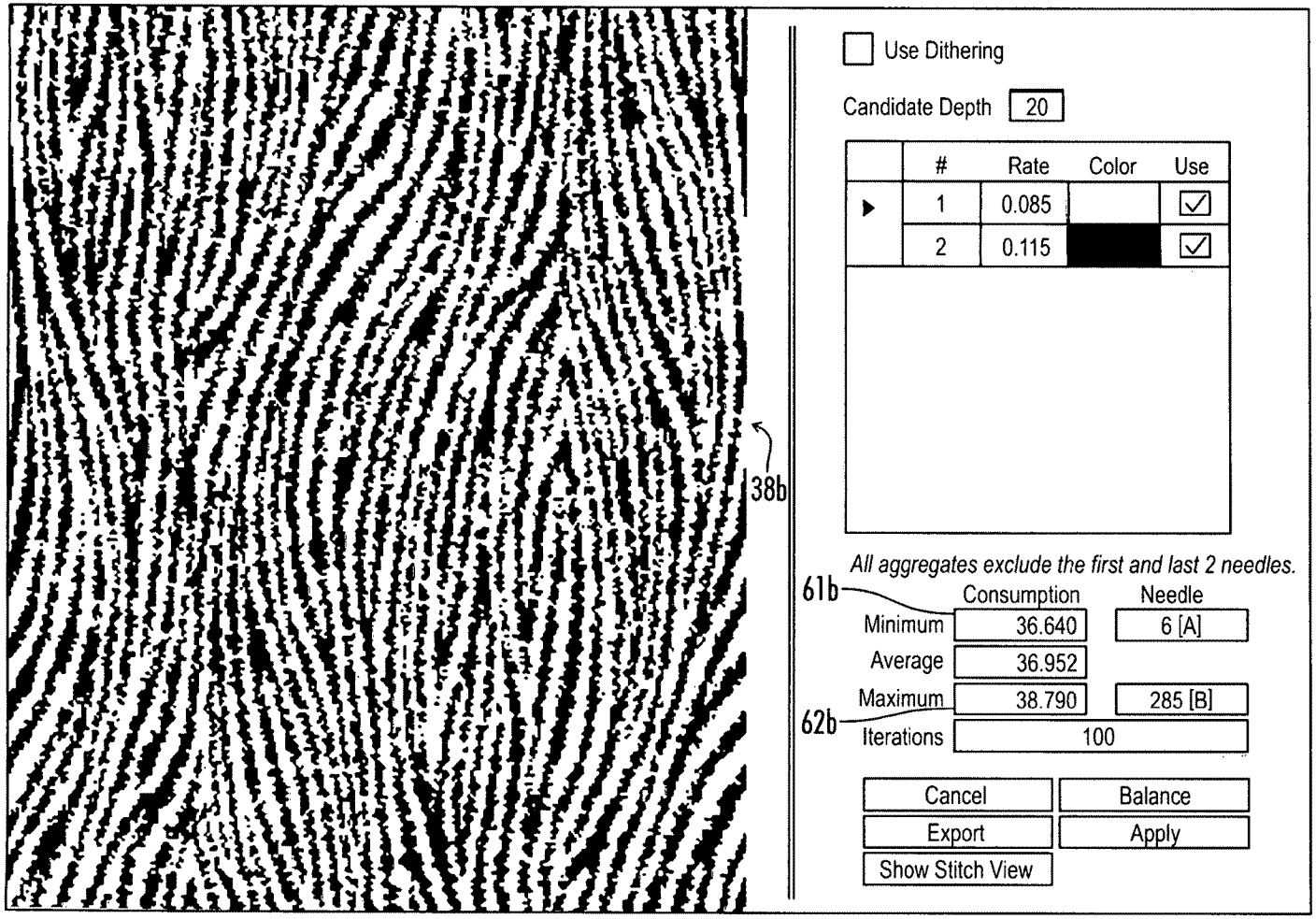
FIG. 8 is an exemplary control screen showing modifications in the appearance of a pixel-mapped design as a balancing algorithm is applied.

Additional variable algorithm characteristics may also be set by the designer 76. A single iteration across the tufting machine is unlikely to resolve the total out of balance situation so that a large number of iterations 63 on the order of 100 or more may be needed to carry out the balancing process. Some rigidly efficient algorithms may make suitable adjustments in only dozens of iterations, however, more subtle algorithms and severely out of balance yarn quantities may result in thousands of iterations being applied to completely optimize a pattern. When the algorithm is applied 77, preferably the graphic display of the pattern 38*a* is shown 78 during the balancing process, with a graphical progress indicator. In the event that the operator determines the pattern graphic 38*b* in FIG. 8 is becoming unreasonably distorted, the balancing operation can be stopped 80 using a stop button on the progress indicator, not shown. If the pattern appearance changes too much, the process may be cancelled 65 and the parameters modified and restarted. In addition, at an intermediate point where the balancing is stopped, the partially balanced pattern can be exported 66 and again utilized in a graphic design setting. This allows modifications to be made to return a partially balanced carpet design to suitable appearance with the balancing process then repeated 81, and this combination of artistic intervention and automated balancing can continue until a balanced and aesthetically suitable design results. Once the design is balanced and is aesthetically suitable, the balanced pattern can be applied 67 (corresponding to translating the pixel-mapped design into Tufting Machine Instructions 39 in FIG. 3) and stored in the tufting machine.

FIG. 8 illustrates the appearance of the pattern 38*b* of FIG. 4 after balancing has been applied to correct substantially all of the below average fed yarns 61*b* and substantially reduce the amount that yarns are fed in excess of average 62*b*. The zebra stripe pattern has been modified 38*b* but still retains an organic appearance.

In a pattern with additional colors, it is possible to lock 68 some colors so that they are not adjusted during the balancing process. In addition, the number of candidate locations for stitch replacement can be specified in the candidate depth 69 field. The complexities in graphic visualization of the balancing process are quite extraordinary since in patterns a single color yarn can be tufted at a variety of different heights. For instance, a yarn might be tufted at a tacking stitch height where it is essentially embedded in the backing fabric, it might be tufted at a low height where the stitch is practically hidden by adjacent stitches, it might be tufted at an intermediate height where the stitch is partially visible, it might be tufted at a high height where the stitch is entirely visible relative to adjacent stitches, and it might be tufted at an even higher height with the intention that the stitch will be tip sheared after the fabric is tufted. For yarn consumption calculation purposes, these yarn feed amounts are combined with variations to compensate for transition stitches (yarn feed amounts change when stitch heights adjust from high to low or vice-versa), and various lateral shifting and stitch rate distance adjustments. For graphic display purposes, each of these intended distinct heights may be represented by different colors though the stitches are all associated with the same color yarn carried by the same needle. Optionally, the display can be modified to show yarns of the same color in a single color and in 3D. In addition, patterns may be tufted on graphics tufting machines that have front and rear needle bars (or front and rear lateral rows of needles on a single staggered needle bar) that can be shifted in unison or independently and stitches from one needle bar are offset from stitches of the other needle bar by a stitch offset quantity so that the patterns tufted by the front needle bar align with the pattern tufted by the rear needle bar.

In the simple cellular automata shown in FIG. 9, the Moore Neighborhood comprises the eight cells surrounding a central cell P on a 2-dimensional square lattice and the Von Neumann Neighborhood comprises the four cells orthogonally surrounding a central cell. If a point P is selected for analysis, weights are assigned to the pixels corresponding to the surrounding cells based upon similarities (or dissimilarities) to the yarn that can be placed by the analyzed needle at point P. For instance, if same color adjacent cells are assigned to value=1 and different color adjacent cells are assigned value=0, then candidates points P with a value of 8 would be the most preferred in a Moore Neighborhood analysis searching for similarity. However, values may be assigned in a large variety of ways with greater weight given to various characteristics, for instance, vertically aligned cells N, S may be weighted more heavily than horizontally aligned cells W, E. Locked yarn colors may be assigned differing or negative weights and weights may be assigned based upon yarn heights and textures in addition to color.

Algorithms may be implemented that tend to either create or break up clumps of color, or that tend to either extend the length or fragment lines of color for instance. Designers will appreciate that different algorithms may be best suited for balancing different styles of patterns with preferred results.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method for optimizing yarn consumption in the manufacture of pixel mapped patterns on tufting machines having an array of independent yarn feed devices feeding yarns to reciprocating needles comprising the steps of:

(a) creating a multi-color pixel mapped pattern design in a bitmap-type file;

(b) loading the bitmap-type file into a computer running yarn consumption optimization software;

(c) setting the lateral shifting profile and stitch rate information that will be used with the pattern design;

(d) assigning yarns that will be threaded on the tufting machine and appropriate yarn feed increments to colors in the bitmap-type file;

(e) computing yarn feed totals by needle;

(f) grouping needles based upon yarn feed totals into at least high and low yarn consumption groups;

(g) selecting the low group of needles for location analysis;

(h) applying an algorithm to place additional stitches for yarns feed to needles in the low group in the place of stitches fed by needles in the high group;

(i) displaying the multi-color pixel mapped pattern design as modified by the algorithm.

2. The method of claim 1 wherein a number of candidate locations for each needle in the low group are selected before application of the algorithm.

3. The method of claim 1 wherein the algorithm is a cell automata algorithm.

4. The method of claim 3 wherein the cell automata algorithm is selected from the group of Von Neumann and Moore type neighborhood algorithms.

5. The method of claim 4 in which the neighborhood algorithm is applied to candidate locations for each needle in the low group and values are assigned to pixels adjacent candidate locations based upon similarities to the yarn carried by the needle.

6. The method of claim 1 wherein yarn feed totals by needle are computed on the multi-color pixel mapped pattern design as modified by the algorithm and, in the event the highest and lowest yarn feed totals exceed a specified threshold, repeating steps (f) through (i).

7. The method of claim 6 wherein prior to repeating steps (f) through (i) the modified pixel mapped pattern design is further modified by an operator.

8. The method of claim 1 wherein the algorithm applied in step (h) is selected from a plurality of algorithms included in the consumption optimization software.

9. The method of claim 1 when prior to applying the algorithm, the operator specifies at least one rule to be applied.

10. The method of claim 9 wherein at least one rule includes specifying at least one needle that is locked from modifying its stitches.

11. The method of claim 9 wherein at least one rule includes specifying a yarn color that is locked from modifying its stitches.

12. The method of claim 1 including loading the multi-color pixel mapped pattern design as modified by the algorithm for tufting in a tufting machine and creating a multi-color tufted fabric.

13. A method for optimizing yarn consumption in the manufacture of pixel mapped patterns on tufting machines having an array of independent yarn feed devices feeding yarns to reciprocating needles comprising the steps of:

(a) creating a multi-color pixel mapped pattern design in a bitmap-type file;
(b) loading the bitmap-type file into a computer running yarn consumption optimization software;
(c) setting the lateral shifting profile and stitch rate information that will be used with the pattern design;
(d) assigning yarns that will be threaded on the tufting machine and appropriate yarn feed increments to colors in the bitmap-type file;
(e) computing yarn feed totals by yarn feed device;
(f) grouping yarn feed devices based upon yarn feed totals into at least high and low yarn consumption groups;
(g) selecting the low group of yarn feed devices for location analysis;
(h) applying an algorithm to place additional stitches for yarns feed through yarn feed devices in the low group in the place of stitches fed by yarn feed devices in the high group;
(i) displaying the multi-color pixel mapped pattern design as modified by the algorithm.

14. The method of claim 13 wherein the yarn feed devices feed at least two yarns in the design.

15. A method for optimizing yarn consumption in the manufacture of pixel mapped patterns on tufting machines having an array of independent yarn feed devices feeding yarns to reciprocating needles comprising the steps of:

(a) creating a multi-color pixel mapped pattern design in a bitmap-type file;
(b) loading the bitmap-type file into a computer running yarn consumption optimization software;
(c) setting the lateral shifting profile and stitch rate information that will be used with the pattern design;
(d) assigning yarns that will be threaded on the tufting machine and appropriate yarn feed increments to colors in the bitmap-type file;
(e) computing yarn feed totals by needle;
(f) grouping needles based upon yarn feed totals into at least high and low yarn consumption groups;
(g) selecting the high group of needles for location analysis;
(h) determining a number of candidate locations for each needle in the high group to be analyzed;
(i) applying a cell automata algorithm to candidate locations and selecting locations in the pixel mapped pattern design to place less yarn in stitches for yarns feed to needles in the high group;
(j) displaying the multi-color pixel mapped pattern design as modified by the algorithm;
(k) loading the multi-color pixel mapped pattern design as modified by the algorithm for tufting in a tufting machine and creating a multi-color tufted fabric.

16. The method of claim 15 wherein the tufting machine is selected from the group of broadloom tufting machines, graphics tufting machines, ICN tufting machines and hollow needle tufting machines.

* * * * *